United States Patent [19]

Smith

[11] Patent Number: 4,717,906

[45] Date of Patent: Jan. 5, 1988

[54] ELECTRIC HORN WITH IMPROVED POLE PIECE AND ADJUSTING CAP

[75] Inventor: Robert E. Smith, Rinard, Ill.

[73] Assignee: Sparton Corporation, Jackson, Mich.

[21] Appl. No.: 922,005

[22] Filed: Oct. 22, 1986

[51] Int. Cl.[4] ..... G08B 3/00; G10K 9/00

[52] U.S. Cl. ..... 340/388; 340/387; 340/391; 340/392; 340/404; 116/59; 116/137 R; 116/142 R

[58] Field of Search ..... 340/388, 387, 390–392, 340/389, 402, 404; 116/59, 142 R, 137 R, 155; 381/86, 111, 158

[56] References Cited

U.S. PATENT DOCUMENTS 4,361,952 12/1982 Neese ..... 116/142 R 4,441,099 4/1984 Neese ..... 340/388

*Primary Examiner*—Donnie L. Crosland

*Attorney, Agent, or Firm*—Reising, Ethington, Barnard, Perry & Milton

[57] ABSTRACT

An electric horn, especially adapted for automotive vehicles includes a pole piece and adjusting cap for the driving motor. The pole piece and adjusting cap include a cylindrical shank and an enlarged head including a conical flange. The flange terminates in an annular rim which is in contact with and secured to the horn housing by resistance welding. A magnetic circuit for the motor extends from the pole face of the pole piece and adjusting cap through the shank and the head to the housing and the cross-sectional area for the flux path through the head is at least as great as that in the shank and sufficiently large to avoid undue magnetic saturation. The rim of the enlarged head has a diameter greater than that of the shank and less than the diameter of the housing coil cup to thereby obtain increased stiffness in the connection of the pole piece and adjusting cap with the housing.

6 Claims, 2 Drawing Figures

ELECTRIC HORN WITH IMPROVED POLE PIECE AND ADJUSTING CAP

FIELD OF THE INVENTION

This invention relates to electric horns of the type adapted for use on vehicles; more particularly, it relates to an improved magnetic pole piece and adjusting cap for such horns.

BACKGROUND OF THE INVENTION

Electric horns for vehicles currently in use comprise, in general, a linear electromagnetic motor mechanically coupled with a sound generating diaphragm which is acoustically coupled with the air column of a sound projector. The motor is mounted within a housing and the diaphragm is mounted on the housing with its periphery in sealing engagement therewith to provide a chamber containing the motor. The motor comprises an annular field coil within a cup-shaped portion of the housing and a pole piece is mounted coaxially of the coil on the bottom wall of the cup-shaped portion of the housing and extending therethrough. A plunger or armature is disposed coaxially of the coil and is mounted on the diaphragm for reciprocating motion along the axis of the coil with an axial air gap between the armature and the pole piece. Thus, a magnetic circuit or flux path is provided through the pole piece, housing, diaphragm, armature and the air gap. The motor is adapted to be energized from the vehicle battery through switching contacts which are opened and closed by the motion of the plunger which vibrates the diaphragm to generate sound energy. In order to obtain the desired level of sound output, the air gap must be adjusted to a predetermined dimension. This adjustment of the air gap is achieved by deforming the bottom wall of the cup-shaped housing to properly locate the pole piece and adjusting cap.

It is desired to improve the operating efficiency and the stability of electric horns of the prior art. The Neese U.S. Pat. No. 4,361,952 granted Dec. 7, 1982, is typical of such prior art. The horn described in the Neese patent has a pole piece with a reduced diameter portion which is press fitted into an opening in the bottom of the cup-shaped housing. A threaded stud on the pole piece serves as a mounting member and an electrical ground connection for the horn. The air gap between the pole piece and the armature is adjusted after assembly by deforming the bottom wall of the cup-shaped housing. The deforming force is applied to the stud on the pole piece and the sheet metal wall of the housing is bent in the vicinity of the pole piece, commonly referred to as the pole piece and adjusting cap and hereinafter referred to as the pole piece/adjusting cap. While the horn of this type has been satisfactory, it is desired to provide improved magnetic circuit efficiency and stability of the pole piece/adjusting cap in its relationship with the armature.

A general object of this invention is to provide an improved pole piece/adjusting cap for an electric horn to overcome certain disadvantages of the prior art.

SUMMARY OF THE INVENTION

In accordance with this invention, an electric horn, especially adapted for vehicle use, is provided with improved operating efficiency and stability and which is economical to manufacture and reliable in operation. This is achieved by an improved pole piece/adjusting cap which provides a magnetic flux path of sufficient cross-sectional area to avoid magnetic saturation and which provides a large diameter engagement with the housing relative to the diameter of the pole face. The pole piece/adjusting cap has a flux path therethrough with a cross-sectional area that is not substantially smaller at any location than the area of the pole face; preferably, the cross-sectional area is substantially uniform. Further, the pole piece/adjusting cap comprises a shank and an enlarged head. The head has an annular rim in engagement with the wall of the housing and the shank has a pole face disposed opposite the armature. Further, the rim is welded to the wall of the housing and a stud is provided on the enlarged head. Further, the housing is cup-shaped and the pole piece/adjusting cap is disposed on the bottom wall thereof and the rim of the head has a larger diameter than the shank and a smaller diameter than the cup-shaped portion of the housing. Further, the shank is circular and is tapered from the head and is press fitted into an opening in the housing. Preferably, the pole face is convex.

A complete understanding of this invention may be obtained from the detailed description that follows taken with the accompanying drawings.

BEST MODE FOR CARRYING OUT THE INVENTION

Figure 1:
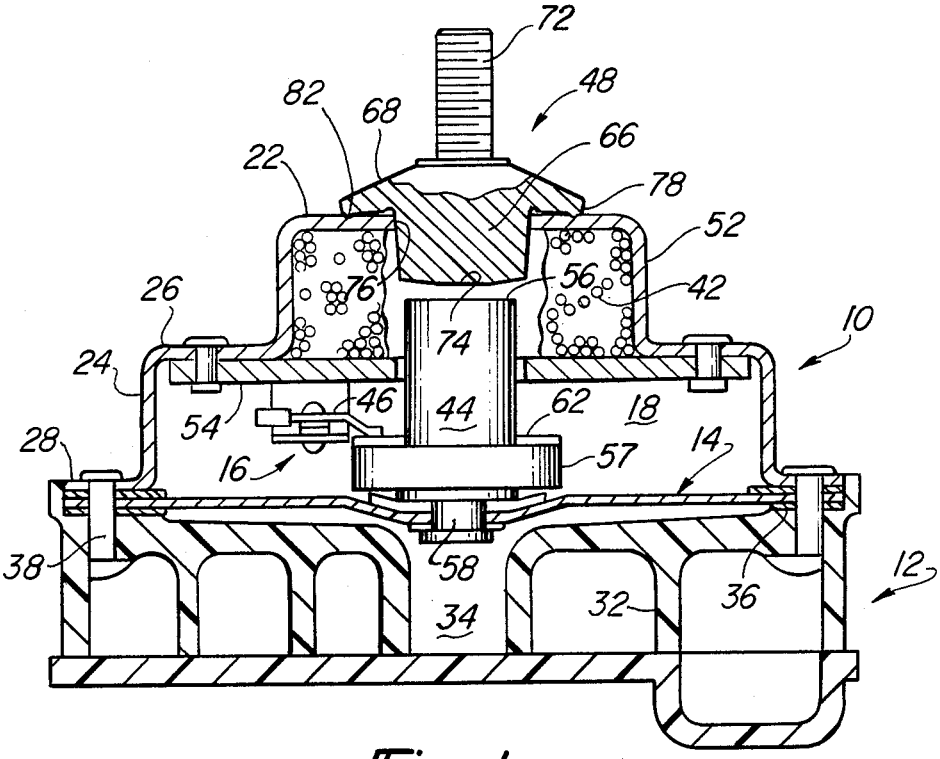
FIG. 1 is a cross-sectional view showing an electric horn embodying the invention.
Figure 2:
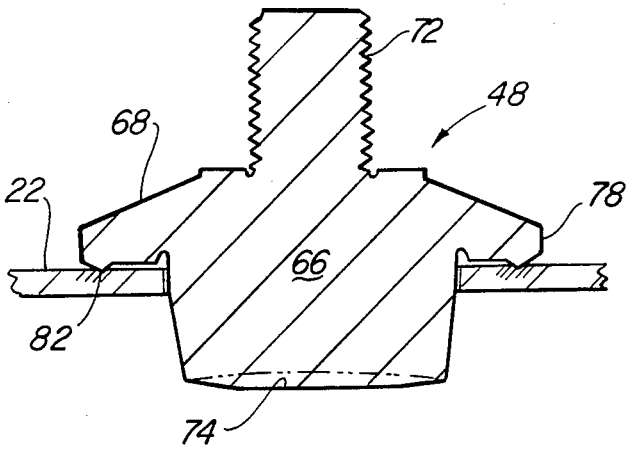
FIG. 2 is a detail view of the improved pole piece/adjusting cap.

Referring now to the drawings, there is shown an illustrative embodiment of the invention in an electric horn especially adapted for use in automotive vehicles. It will be appreciated as the description proceeds that the invention is also useful in various types of electric horns and may be realized in various embodiments.

Referring now to the drawings, there is shown an electric vehicle horn of the acoustical type with the improved pole piece/adjusting cap of this invention. The horn comprises, in general, a housing 10 upon which a sound projector 12 is mounted with a diaphragm 14 therebetween. The diaphragm is driven by a linear electromagnetic motor disposed within the housing. The housing 10 and the diaphragm 14 define a motor chamber 18. Before describing the electromagnetic motor 16, the horn will be described in greater detail.

The housing 10 is generally cup-shaped and is formed of a ferromagnetic sheet metal. It is of circular cross-section and has a flat rear wall 22 and a stepped side wall 24 having an intermediate radially extending shoulder 26 and terminating in an annular diaphragm mounting flange 28. The sound projector 12 is of the convoluted type and comprises a body of molded plastic with an internal spiral passage 32. The body of the projector 12 defines a plenum chamber 34 at the inlet of the passage and the passage extends in a divergent manner through the body and terminates at its outlet to the atmosphere in a bell (not shown). An annular seating surface 36 is provided on the rear face of the projector 12 for mounting of the diaphragm 14. The diaphragm 14 is constructed of a thin sheet of ferromagnetic metal and is circular in shape. The periphery of the diaphragm is disposed between the mounting flange 28 and the seating surface 36 with suitable gaskets; rivets 38 extend therethrough to secure the assembly together. Thus, an air tight seal is provided around the periphery of the diaphragm.

The linear electromagnetic motor 16 comprises, in general, an annular field coil 42, a plunger or armature 44, a switch 46 and a magnetic circuit including the pole piece/adjusting cap 48 of this invention. The annular coil 42 is mounted within a cup-shaped portion or coil cup 52 of the housing 10. The coil is disposed against the bottom wall 22 and is held in place by a yoke 54 which is secured by rivets to the shoulder 26 of the housing. The armature 44 is of stepped cylindrical configuration and is constructed of ferromagnetic material. The armature terminates at its rear end in a pole face 56 within the annular coil 42. The armature is provided with an annular flange 57 of enlarged diameter and a mounting stem 58 of reduced diameter. The stem 58 extends through a central opening in a saucer-shaped portion of the diaphragm 14. The armature is secured to the diaphragm by an upset head on the stem 58 and suitable washers and gaskets are disposed between the head and the annular flange 57. The switch 46 comprises a pair of contacts which are adapted to connect the coil 42 with the battery of the vehicle through a horn switch (not shown). The switch 46 includes an actuating member which overlies an insulating washer 62 on the annular flange 57 and is actuated by movement of the armature to open and close the switch contacts to control energization of the coil. The magnetic circuit for the flux generated by the coil 42 includes the armature 44, the diaphragm 14, the housing 10 and the pole piece/adjusting cap 48 and an air gap between the latter and the armature. When the coil is energized, the armature 44 is caused to reciprocate and thus vibrate the diaphragm 14 to generate sound energy which is transmitted through the projector 12.

The pole piece/adjusting cap 48 comprises, in general, a shank 66, an enlarged head 68 and a stud 72 extending from the head. The pole piece/adjusting cap is made of a ferromagnetic material and is circular in cross-section. The shank 66 is tapered slightly from the head 68 and terminates in a pole face 74. The pole face is slightly convex and may be formed with a substantially flat central portion and slightly beveled outer portion to enhance operational stability of the horn. The tapered shank 66 is press-fitted into a circular opening 76 in the bottom wall 22 of the housing. The head 68 comprises a conical flange which terminates in an annular rim 78 and thus the axial thickness of the head diminishes from the axis thereof to the rim 78, for reasons to be discussed presently. The rim 78 is of smaller diameter than the coil cup 52 and of larger diameter than the shank 66. An annular ridge 82 is provided at the lower surface of the rim 78 to facilitate electric resistance welding of the rim 78 to the bottom wall 22 of the housing. For this purpose, the head 68 is pressed into engagement with the wall 22 to bury the ridge 82 into the wall 22. The rim 78 is resistance welded to the wall and an annular weld band of relative broad area is provided. The stud 72 is threaded and is adapted to receive a mounting bracket secured to the stud by a nut. The stud 72 serves as the grounding contact for the electric circuit of the horn.

After the horn is assembled, the air gap between the pole face 56 and the pole face 74 is adjusted. The air gap adjustment is accomplished by deforming the bottom wall 22 of the housing 10. One technique for air gap adjustment is described and claimed in U.S. Pat. No. 4,361,952 granted Dec. 7, 1982. In general, this adjustment is accomplished by use of apparatus which grips the pole piece/adjusting cap 48 and displaces it axially relative to the housing 10. When the pole piece/adjusting cap 48 is axially displaced, the bottom wall 22 is deformed in the vicinity of the rim 78. Since the rim 78 is of substantially larger diameter than the shank 66 but of smaller diameter than the coil cup 52, the bending of the housing only in the annular band surrounding the rim 78 results in severe work-hardening of the metal. This results in a high degree of stiffness with a minimum of spring-back after the deforming force is removed. Further, the relatively large diameter of the rim 78 provides a large area of support for the housing. This arrangement enhances the mechanical stability of the alignment and length of the air gap between the pole faces 56 and 74. It also enhances the ability to maintain parallelism between the diaphragm mounting flange 28 of the housing and the pole face 74 of the pole piece/adjusting cap 48. Improved stability and alignment of the pole faces 56 and 74 provides improved operating efficiency and performance of the horn.

The pole piece/adjusting cap 48 provides an improved magnetic circuit for the horn motor 16. As described above, the magnetic circuit for the coil 42 includes the armature 44, the pole piece/adjusting cap 48 and the air gap therebetween. It also includes the housing 10 and the diaphragm 14. In the pole piece/adjusting cap 48, the magnetic flux path extends from the pole face 74 through the shank 66 and thence through the head 68 to the interface of the rim 78 with the wall 22 of the housing. The cross-sectional area of the flux path through the head 68 is at least as large as the cross-sectional area of the flux path through the shank 66 which is sufficiently large to carry the magnetic flux without undue saturation, thereby minimizing energy loss in the magnetic circuit. Preferably, the cross-sectional area of the flux path in the head 68 is substantially equal to that in the shank 44 and thus, the thickness of the conical flange of the head 68 is diminished with increasing radius, thereby minimizing the amount of material required for the head 68. The annular weld band between the rim 78 and the wall 22 along the annular ridge 82 is wide enough to provide a cross-sectional area for the flux path which is at least as great as the cross-sectional area of the flux path in the shank 66. The entire magnetic circuit may thus be designed to operate without magnetic saturation and the operating efficiency is thereby increased.

Although the description of this invention has been given with reference to a particular embodiment, it is not to be construed in the limiting sense. Many variations and modifications will now occur to those skilled in the art. For a definition of the invention reference is made to the appended claims.

What is claimed is:

1. In a vehicle horn of the type comprising a housing, a linear electromagnetic motor disposed in said housing and a sound generator including a diaphragm coupled with said motor for actuation thereby, said motor including an annular field coil in said housing, a pole piece/adjusting cap mounted coaxially of said coil on a wall of said housing and extending therethrough, an armature disposed coaxially of said coil and mounted on said diaphragm for reciprocating motion along the axis of said coil with an axial air gap between the armature and the pole piece/adjusting cap, whereby a magnetic flux path extends through said pole piece/adjusting cap, housing, diaphragm, armature and air gap, the improvement comprising:

said pole piece/adjusting cap having a shank and an enlarged head, the head having an annular rim in engagement with said wall of the housing, the shank having a pole face disposed opposite said armature, said pole piece/adjusting cap having a flux path therethrough with a cross-sectional area that is not substantially smaller at any location than the area of said pole face.

2. The invention as defined in claim 1 wherein said flux path has a substantially uniform cross-sectional area.

3. The invention as defined in claim 2 wherein said rim of the pole piece/adjusting cap is resistance welded to said wall and said pole piece/adjusting cap includes a stud extending from said head.

4. The invention as defined in claim 3 wherein said housing has a cup-shaped portion and said pole piece-/adjusting cap is mounted on the bottom wall of said cup-shaped portion, said rim having a smaller diameter than said cup-shaped portion and a larger diameter than said shank.

5. The invention as defined in claim 4 wherein said shank is circular and is tapered from said head to said pole face and is press fitted in an opening in said housing.

6. The invention as defined in claim 5 wherein said pole face is convex.

* * * * *